United States Patent [19]

Koehl

[11] 4,259,029

[45] Mar. 31, 1981

[54] ARTICULATED PANEL STRUCTURE FOR LINING EXCAVATION TRENCHES

[76] Inventor: Jean-Marie Koehl, 3, rue Varengue, 92340 Bourg-la-Reine, France

[21] Appl. No.: 914,002

[22] Filed: Jun. 9, 1978

[30] Foreign Application Priority Data

Jun. 9, 1977 [FR] France ..... 77 17753

[51] Int. Cl.[3] ..... E21D 5/12

[52] U.S. Cl. ..... 405/282; 405/274

[58] Field of Search ..... 405/272, 282, 283, 284, 405/285, 262, 274; 52/487, 486, 562, 563, 564, 582, 585; 256/22, 24, 73

[56] References Cited

U.S. PATENT DOCUMENTS

| | | | |
|---|---|---|---|
| 1,483,825 | 2/1924 | Martinez | 405/274 |
| 3,067,985 | 12/1962 | Cusack | 256/22 |
| 3,393,521 | 7/1968 | Cammisa | 405/282 |

FOREIGN PATENT DOCUMENTS

| | | | |
|---|---|---|---|
| 160116 | 5/1933 | Switzerland | 405/282 |

*Primary Examiner*—Dennis L. Taylor

*Attorney, Agent, or Firm*—Hauke and Patalidis

[57] ABSTRACT

An articulated deformable panel structure, for lining the walls of excavation trenches, formed of a plurality of individual panel elements co-planarly disposed side by side in interlocked relationship and interconnected by means of ties permitting each panel element to be displaced longitudinally relative to an adjacent panel element such as to progressively deform the panel structure by progressively displacing one panel element relative to the next one to insert the whole panel structure into the ground by applying pressure alternatively on the top of the panel element at one end or the other of the panel structure, and to remove the panel structure from the ground by pulling on the panel element at one end or the other of the panel structure.

8 Claims, 15 Drawing Figures

ARTICULATED PANEL STRUCTURE FOR LINING EXCAVATION TRENCHES

BACKGROUND OF THE INVENTION

According to present technology, when it is desired to support the walls of excavations, and more particularly the walls of large dimension trenches dug in the ground, it is common to drive into the ground a plurality of piles, generally metallic and having a great length, in the form of profiled members into the ground side by side by means of air, steam or hydraulic hammers, the piles having a transverse structure providing mutual interconnection for example by means of bent-over longitudinal edges.

After all the required piles have been driven in the ground, the trench is dug between two rows of piles, the desired work is effected, such as placing a footing, a foundation, installing conduits of large diameter, etc., and the trench is filled up. The piles must then be pulled one by one from the ground in order to extend the trench or, when the work is finished, in order to recover the piles for use at other work sites.

It is easily understood that such an operation takes considerable time, requires specialized manpower and equipment and is consequently accomplished only at substantial costs.

The present invention remedies the inconveniences of the prior art by providing an articulated deformable panel structure which may be pre-assembled, or assembled on site in the trench, such as to be placed without difficulty for supporting the walls of a trench or other excavation, the articulated panel assembly progressively sinking partly under its own weight and partly with the help of equipment normally used during excavating, for example a bucket digger. The walls of the trench being dug are perfectly supported and consequently any risk of landslide is avoided during excavation as well as in the course of working in the trench, or laying a conduit in the trench. The articulated deformable panel assembly can subsequently be easily removed in totality or in part becasue after dismantling, the crossbars or struts interconnecting a pair of panel assemblies forming, for example, a cofferdam, every single panel assembly made of a plurality of profiled panel elements or piles of appropriate material and strength may be removed by deforming in its own plane the rectangular panel of the articulated assembly, such as to obtain deformable parallelograms by consecutive longitudinal displacement of an end of the panel assembly followed by a displacement of the other end, that is by lifting one end of the deformable panel assembly, then the other, until the panel assembly is extracted from the ground.

It is also possible to drive the panel assemblies in a manner similar to that hereinabove described, by pushing alternatively on one end or the other of the deformable panel assemblies, or the assembly of individual panel elements which are held together by means of ties permitting relative motion of one panel element relative to the others.

SUMMARY

In accordance with the present invention, individual panel defining members or elements are interconnected by means of at least one cross-bar or tie provided with connecting members suitably spaced and inserted in appropriate apertures disposed in the individual panel elements co-operating in unison for forming a full articulated deformable panel, the connecting members being so shaped and dimensioned as to allow a predetermined angular misalignment of each panel defining individual elements, each relative to another, such as to enable placing in position into the ground or extracting from the ground the full panel assembly by controlled deformation of the assembly in a single plane, either by pushing or by pulling on one or the other of the articulated deformable panel ends.

According to another aspect of the invention, the connecting members are shaped such that the interconnecting of the diverse elements is effected by a single simple locking operation, for example by a simple rotation of the connecting members relative to the other elements of the assembly.

According to a further aspect of the present invention, the connecting members may, for example, be in the form of a tooth-like hook member whose upper portion has a cam-shaped surface to facilitate the introduction of hook member by rotation into the aperture of the interconnectible panel elements.

These and other objects and advantages of the present invention will be apparent from the following detailed description of some of the best modes contemplated for practicing the invention and from the accompanying drawing given for illustrative purpose and in which:

DETAILED DESCRIPTION OF THE PREFERRED EMBODIMENTS

Figure 1:
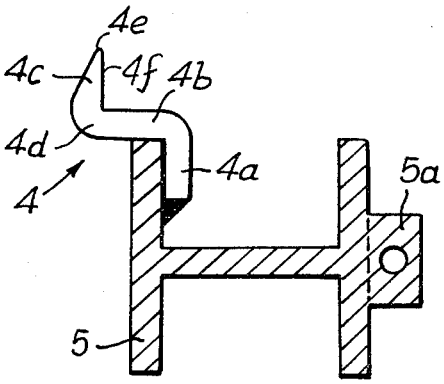
FIG. 1 represents partly in elevation and partly in section a connecting member or tie for interconnecting a plurality of individual panel elements.
Figure 3:
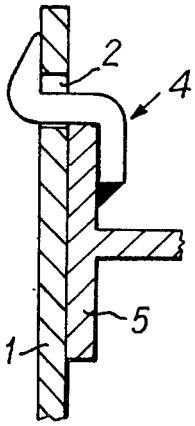
FIG. 3 is a view similar to FIG. 2 but showing the connecting member fully placed in position.
Figure 4:
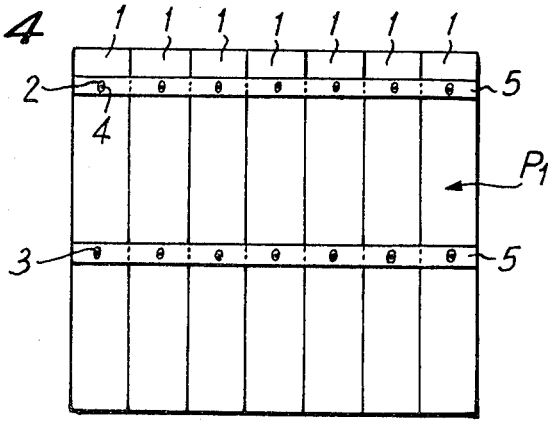
FIG. 4 is a plan view of a plurality of sectional individual panel elements forming an articulated deformable panel assembly, provided with a pair of parallel connecting members.

According to the present invention, a deformable articulated panel assembly for supporting the walls of an excavation (for example and among others, a trench, a well, etc.) is made as follows:

A predetermined number of preferably identical rectangular profiled members, made of an appropriate material, such as steel capable of being subjected to an appropriate stress, and hereinafter referred to as individual panel elements or piles, for example seven in number as shown in FIG. 4, are placed in a single plane adjacent to each other and/or interlocked with each other at their edge by means of an edge longitudinal rib, as is well known in the art. The individual panel elements or piles 1 are provided with at least one aperture or, preferably, a pair of apertures 2 and 3, disposed one proximate one end of the panel element 1 and the other intermediate the ends. In each aperture 2 or 3, there is passed a tooth-like hook member 4, best shown in FIGS. 1–3, affixed by any convenient means, such as welding, to the upper internal portion of a cross-bar member or tie 5 which is shown as being generally H-shaped in section, but which may alternatively have any other shape, such as, for example, a T-shape. As shown in detail at FIG. 1, each tooth-like hook member 4 has a lower end portion 4*a*, disposed vertically as shown in the drawing, affixed by convenient means, such as for example by welding, to the tie 5 and a main body portion 4*b* bent over substantially at right angle and disposed horizontally in the drawing, the main body portion 4*b* ending in a free end portion 4*c* disposed substantially generally parallel to the end portion 4*a* and provided with a rectilinear internal face 4*f* and a rounded external face 4*d*, the free end portion 4*c* tapering in a cam-like manner towards a sharp tip 4*e*.

Figure 2:
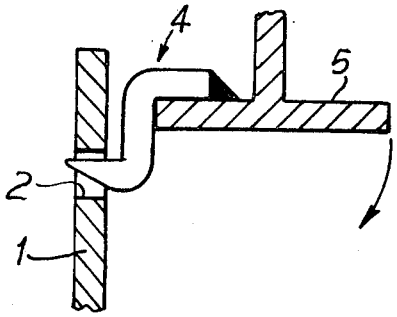
FIG. 2 illustrates the connecting member of FIG. 1 being placed in position into an individual panel member.
Figure 3A:
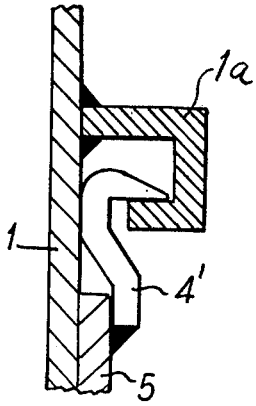
FIG. 3*a* is a view similar to FIG. 3 but showing a modification of the connecting member.

As can be readily seen at FIGS. 2 and 3, a predetermined number of individual panel elements or piles 1, disposed side by side, can be interconnected by means of one or of a pair of ties 5 by introducing the tooth-like hooks 4 of the tie in the rows of apertures 2 or 3, the apertures 2 and 3 having a diameter sufficient to permit easy introduction of the tip of the hook 4 and also to provide a predetermined clearance around the main body portion 4*b* of the hook 4. In the example of structure illustrated at FIGS. 2–3, the tooth-like hook 4 is introduced in the aperture 2 in each individual panel element 1 to provide an appropriate interlocking of the plurality of individual panel elements 1 (FIG. 4) to form a single articulated deformable panel P1. However, it will be apparent to those skilled in the art that it is within the purview of the invention to provide other means for interconnecting the individual panel element or piles 1 by means of the ties 5. For example and as shown at FIG. 3*a*, the individual panel elements or piles 1 may be provided with a generally U-shaped bracket 1*a*, as schematically shown, defining an appropriate recess for introduction therein of appropriately shaped tooth-like hook members 4′ affixed to the tie 5. It is also possible to utilize, as hereinafter disclosed, a connection between the ties and the individual panel elements by means of nuts and bolts, instead of the co-operating tooth-like hook member and aperture arrangement. It is only critical, according to the invention, that the co-operating members of the individual panel elements and of the ties be interconnected with a certain amount of play. The invention further permits to disconnect an individual panel element from the tie and to lift it as desired, or even to remove it, to afford passage to parts or conduits.

As illustrated at FIG. 4, an articulated deformable panel P1 is thus formed of a plurality of vertically disposed individual panel elements or piles 1 and of generally horizontally disposed connecting members, such as the ties 5. A pair of spaced apart panels P1 are capable of being interconnected in parallel relationships by means of appropriate stays or struts whose heads are fastened to extensions 5*a*, in the form of bosses, integral or affixed to the ties 5. In such manner, appropriate caissons of cofferdams may be pre-assembled with a rigidity which is adequate for transportation to the site of a trench being excavated, the caissons or cofferdams being able to sink in the ground under their own weight or aided by a slight push effected on their top as the excavation of the trench proceeds, thus providing a permanent and progressive support for the trench walls as digging goes on. Landslides are thus prevented even in very loose grounds such as grounds having the consistency of soft mud, especially when work is effected at the edge of a river or in an area which underground water streams are common. It is also possible to sink into the ground the articulated deformable panel P1 by applying pressure alternatively on one side and the other of the panel, in a manner similar to that hereinafter explained for removing from the ground an articulated deformable panel according to the present invention.

Figure 5:
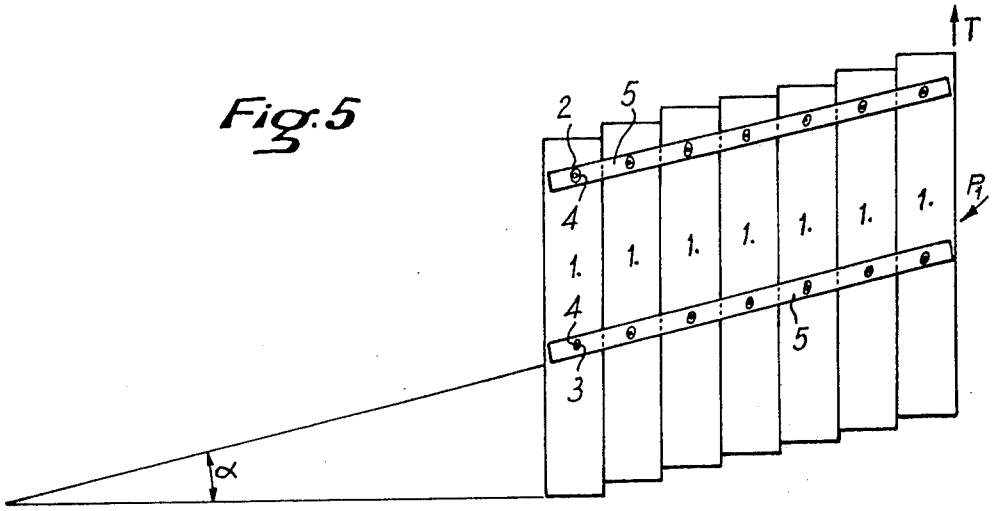
FIGS. 5 and 6 are schematic views illustrating the manner in which the panel assembly of the invention are articulated or deformable.
Figure 6:
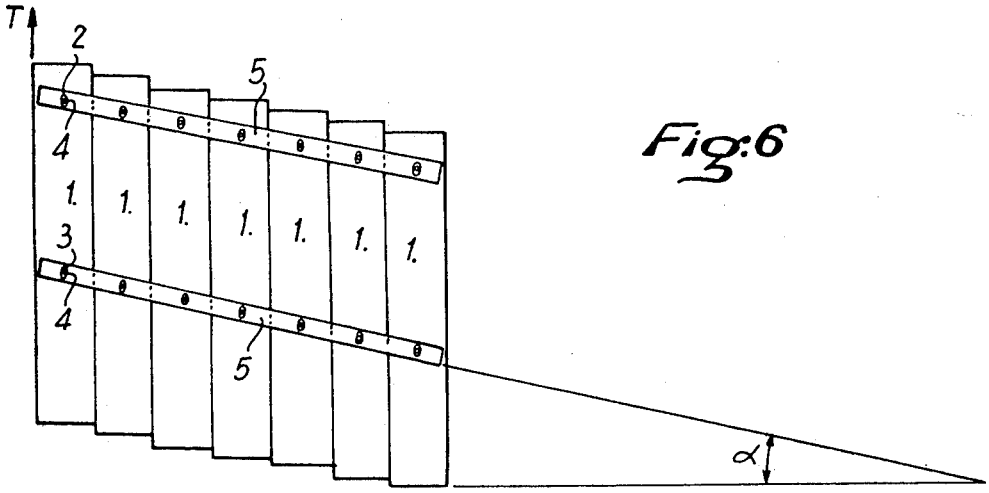

As can be ssen at FIGS. 5 and 6, when the required work is finished and the articulated deformable panels P1 are no longer required on site, after having removed the struts, which may nevertheless be accomplished in most cases during the completion of the work in the event that concrete is poured in situs, it is a simple matter to remove each panel P1 by exerting a pull T, for example by means of a cable, on the individual panel element 1 situated at the extreme right edge, for example, of the panel, or on the right end of the tie 5, for causing a deformation of the panel P1, FIG. 5, in the form of a parallelogram which can be accomplished, up to an angle $\alpha$ relative to the horizontal, as a result of the difference in sizes between the apertures 2 and 3 and the outer diameter of the main body portion 4*b* of the tooth-like hook members 4 or, in general as a result of the loose connections between the individual panel elements or piles and the ties. When the panel P1 is deformed to the shape represented at FIG. 5, the cable attached to the rightmost individual panel element or pile 1, or at the right end of the tie 5, is disconnected and re-attached to the leftmost individual panel element or pile 1, or to the left end of the tie 5, FIG. 6. A pull, as shown by arrow T is exerted on the leftmost individual panel element of pile 1 until the panel P1 is sufficiently deformed in an opposite direction, such deformation being possible up to an angle value $\alpha$, such angle being determined between the horizontal and the orientation of the tie 5 as a result of the traction T exerted on the leftmost individual panel element or pile 1. It is thus possible to remove an articulated deformable panel P1 from the ground, rapidly and without using excessive power, by alternatively lifting the rightmost and the leftmost edge of the panel, for example simply by using the oscillating working arm of a power shovel. Very little energy is required because the whole panel is not pulled from the ground in one solid piece, but by way of several consecutive steps consecutively displacing each of the individual elements forming the whole panel, which are each displaced singly along a short distance. It is only after a single panel element has been displaced that the next one can be displaced in turn. It is thus possible to remove the trench wall lining in a very simple manner.

It is also possible to utilize a similar procedure when the panels are sunk into the ground by pushing alternatively upon the leftmost individual panel element of a panel and rightmost assembly, such as to push into the ground consecutively and separately all of the individual panel elements forming the articulated deformable panel.

It has been previously indicated that the connecting means or ties 5 instead of being provided with tooth-like hooks of a particular shape, as hereinbefore described, can also be provided in the alternative with a removable connecting means. The ties 5 are thus provided with fastening members having an horizontal axis and with a removable locking means placed on the outer face of the individual panel elements or piles in registry with the apertures 2 or 3, the outer diameter of the connecting means being smaller than the diameter of the apertures 2 and 3 in order to permit a parallelogram deformation of the panels P1 formed by the assembly of the individual panel elements.

Figure 7:
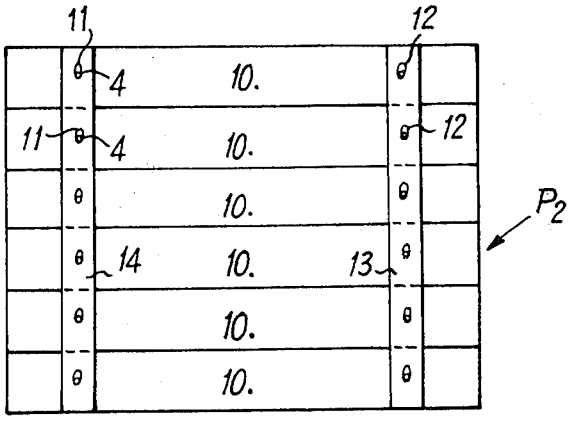
FIGS. 7, 8 and 9 are schematic views similar respectively to FIGS. 4, 5 and 6, but showing an articulated deformable panel assembly disposed horizontally.
Figure 8:
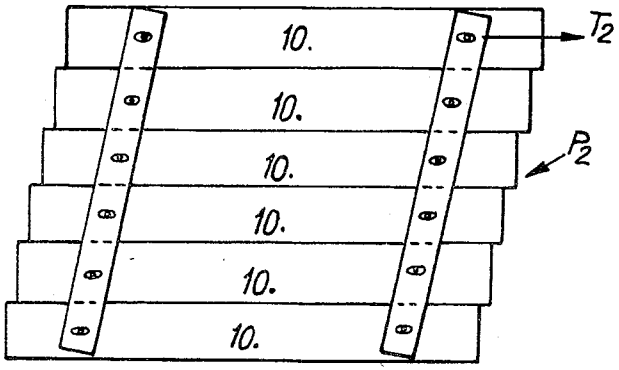
Figure 9:
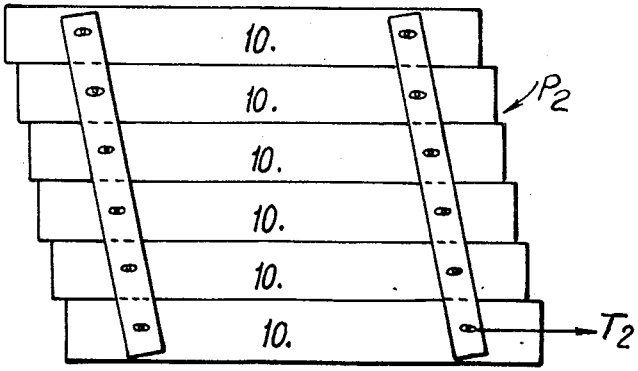

FIGS. 7, 8 and 9 illustrate an arrangement formed of a plurality of individual panel elements 10 disposed horizontally and provided each with a pair of apertures 11 and 12 each disposed proximate an end of the individual panel element. A pair of ties 13 and 14, disposed substantially vertically, are provided with tooth-like hook members 4, identical or similar to those previously described, whose extremities are introduced into an aperture 11 or 12 for forming a panel P2 made of horizontal unitary elements, capable of limited lateral sliding relative to each other when they are placed in a trench for supporting the walls of the trench. The relative displacement of the unitary individual panel elements 10 causing the deformation of the panel P2, as shown at FIGS. 8 and 9, is effected by way of a pull T2 exerted substantially horizontally and applied alternatively to the top and to the bottom of the panel P2. In such a manner, the power required for exerting the pull T2 is substantially reduced because, each time, only a movable portion of each full panel is displaced, which considerably reduces the amount of force to be exerted even if considerable pressure is applied to the outer faces of the panel P2 as a result of the work effected in the trench, or as a result of the effect of the ground whose texture, in some circumstances, can cause substantial adhesion to and skin friction with the panel surface.

Figure 10:
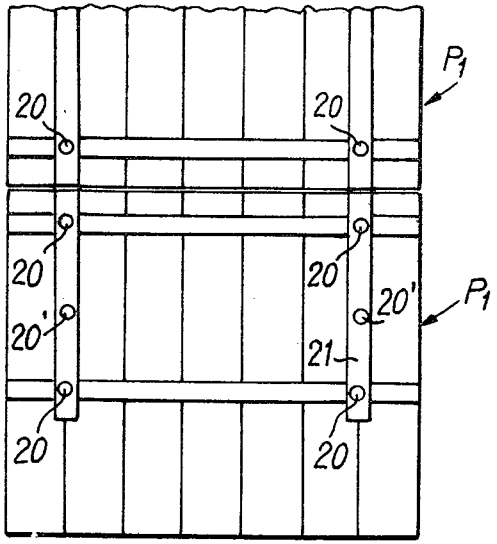
FIG. 10 schematically illustrates an assembly made of a pair of superimposed articulated deformable panels for use in deep trenches.

FIG. 10 illustrates a pair of panels P1 superimposed and interconnected by means of one or a pair of cross-bars or ties 21, and which are connected to opposite panels, not shown, by means of struts whose feet imprints are shown at 20. The struts, which are arbitrarily illustrated by their foot imprint 20, can be displaced upwardly to the position for example shown by the foot imprints 20', for placing, for example, a conduit in position in the trench. Although not shown in the drawing, the cross-bars or ties 21 may be mounted at the end of the panels and be provided with interlocking male and female projections providing vertical guiding and interconnection between the two panels P1. The panels P1 of FIG. 10, which permit to line the walls of a trench to a greater depth, can easily be removed from the ground at the end of the work in a similar manner as previously described and as illustrated at FIGS. 4–6.

Figure 12:
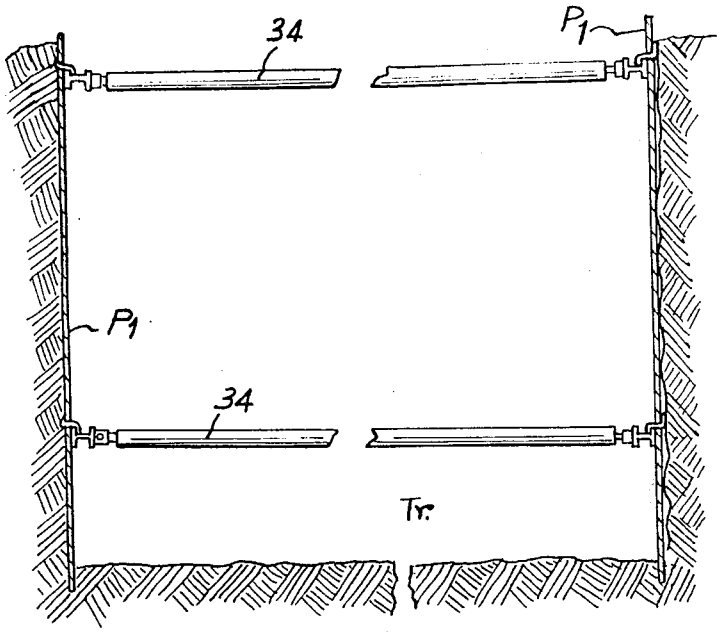
FIGS. 11 through 14 schematically illustrate the use of a cofferdam made of panel assemblies according to the invention being progressively placed in position in a deep trench.
Figure 11:
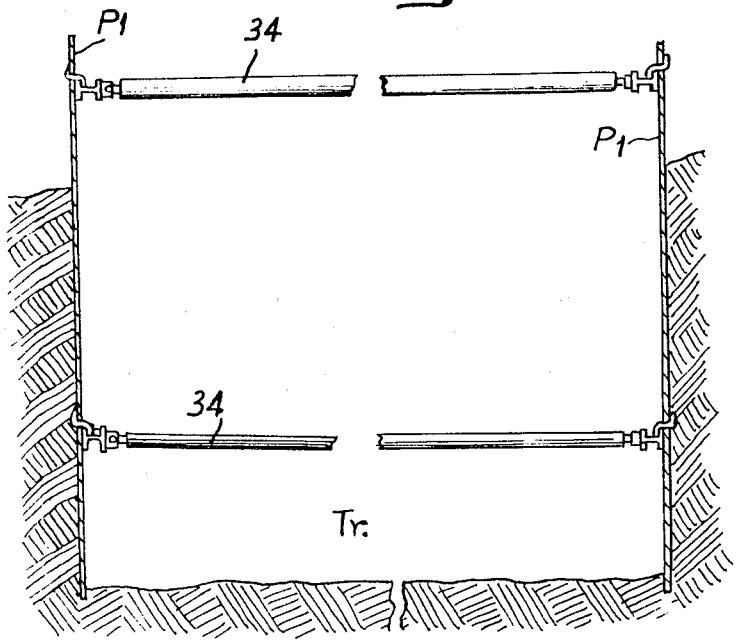
Figure 14:
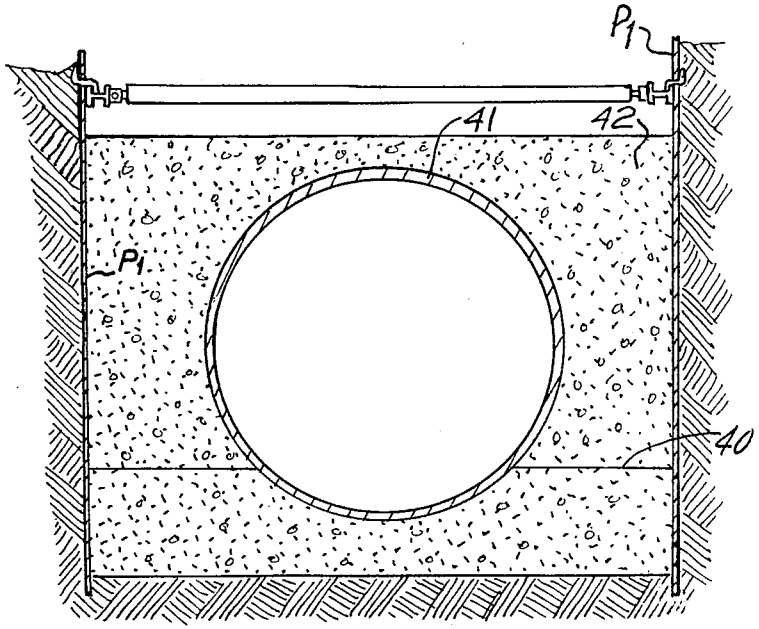
Figure 13:
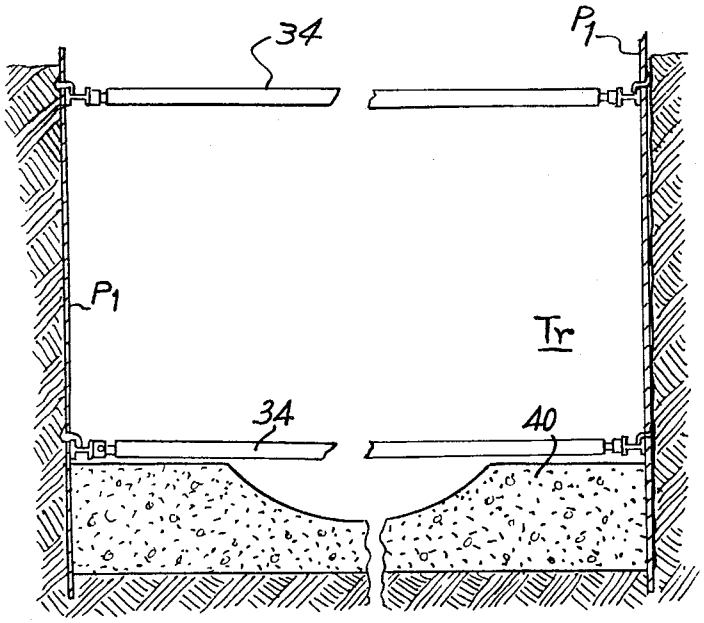

FIGS. 11 through 14 schematically illustrate the digging of a trench Tr whose walls are supported by means of a pair of parallely disposed panels P1 maintained at an appropriate distance from each other by means of struts 34. When the trench Tr is begun, the coffer formed by the pair of panels P2 interconnected by the struts 34 is caused to progressively sink down as the excavation progresses, as shown at FIG. 11 and 12, until the trench reaches the required depth. Any of the required work can then be accomplished such as, for example, the pouring in place of a floor or apron 40, FIG. 13, following which the bottom struts 34 are removed, the floor or apron 40 holding the panels P1 in position at their footing. A conduit 41 may be disposed on the floor or footing, FIG. 14, and the trench filled up with concrete 42 or fill dirt, following which the panels P2 are removed by successive deformations and pulls in opposite directions, as previously explained.

Having thus described the present invention by way of examples of structure thereof, modification whereof will be apparent to those skilled in the art, what is claimed as new is as follows:

1. An articulated deformable panel structure for lining an excavation, said panel structure comprising a plurality of individual adjoining panel elements, tie means for interconnecting said adjoining panel elements in mutually slidable edge engagement, and interconnecting means between each of said individual adjoining panel elements and said tie means, said interconnecting means being shaped and dimensioned for allowing a limited predetermined longitudinal displacement of an individual panel element relative to an adjacent adjoining individual panel element and maintaining slidable edge engagement therebetween for causing said articulated deformable panel structure to be inserted as a single structure into the ground and extracted from the ground by deformation of said panel within a single plane.

2. The panel structure of claim 1 wherein said interconnecting means comprises said individual panel elements having each at least an aperture and said tie member having a corresponding projecting member, the size of the aperture being greater than the size of the projecting member.

3. The panel structure of claim 1 wherein said interconnecting means have a shape permitting interconnecting said tie member with each said individual panel element by relative rotation of said tie and said individual panel elements.

4. The panel structure of claim 2 wherein said projecting member interlocks in said aperture by rotation of said projecting member relative to said aperture.

5. The panel structure of claim 2 wherein said projecting member is in the form of a hook having a cam-like end portion insertable in the aperture disposed in said individual panel element.

6. The panel structure of claim 4 wherein said connecting member is in the form of a hook having a cam-like end portion insertable in the aperture disposed in said individual panel element.

7. The panel structure of claim 1 wherein said tie member is H-shaped in cross-section.

8. The panel structure of claim 1 wherein said tie member is T-shaped in cross-section.

* * * * *

UNITED STATES PATENT AND TRADEMARK OFFICE

CERTIFICATE OF CORRECTION

PATENT NO. : 4,259,029

DATED : March 31, 1981

INVENTOR(S) : Jean Marie Koehl

It is certified that error appears in the above—identified patent and that said Letters Patent is hereby corrected as shown below:

Column 6, line 3, "P2" should read -- P1 --.

Column 6, line 14, "P2" should resd -- P1 --.

Signed and Sealed this

*Twenty-first* Day of *July 1981*

[SEAL]

*Attest:*

GERALD J. MOSSINGHOFF

*Attesting Officer*

*Commissioner of Patents and Trademarks*